United States Patent [19]

Ernst et al.

[11] 4,271,590

[45] Jun. 9, 1981

[54] DRY SHAVING APPARATUS

[75] Inventors: Rolf Ernst, Glashütten; Roland Ullmann, Hausen, both of Fed. Rep. of Germany

[73] Assignee: Braun Aktiengesellschaft, Frankfurt am Main, Fed. Rep. of Germany

[21] Appl. No.: 80,783

[22] Filed: Oct. 1, 1979

[30] Foreign Application Priority Data

Oct. 6, 1978 [DE] Fed. Rep. of Germany ..... 2843657

[51] Int. Cl.[3] ..... B26B 19/04

[52] U.S. Cl. ..... 30/43.92; 30/346.51

[58] Field of Search ..... 30/43.91, 43.92, 346.51

[56] References Cited

U.S. PATENT DOCUMENTS

| | | | |
|---|---|---|---|
| 3,218,708 | 11/1965 | Spohr | 30/43.92 |
| 3,399,454 | 9/1968 | Liska | 30/43.92 |
| 3,646,673 | 3/1972 | Yamaoka | 30/43.92 |

FOREIGN PATENT DOCUMENTS

| | | | |
|---|---|---|---|
| 1801545 | 4/1969 | Fed. Rep. of Germany | 30/43.91 |
| 2904300 | 8/1979 | Fed. Rep. of Germany | 30/43.92 |
| 2819715 | 11/1979 | Fed. Rep. of Germany | 30/43.92 |
| 1127649 | 9/1968 | United Kingdom | 30/43.92 |

*Primary Examiner*—Gary L. Smith

*Attorney, Agent, or Firm*—Michael J. Striker

[57] ABSTRACT

A dry shaving apparatus has a shearing foil, a reciprocable blade member cooperating with the shearing foil, a pressure spring urging the blade member toward the shearing foil and extending with the former in a first direction, a shearing head frame, and an auxiliary frame insertable into the shearing head frame and mounting the shearing foil so that it is convex. The auxiliary frame is fixed to the shearing foil at one longitudinal side of the former and is resiliently yieldable in the first direction. The auxiliary frame is arrested in the shearing head frame at the ends of the former.

14 Claims, 5 Drawing Figures

FIG. 2
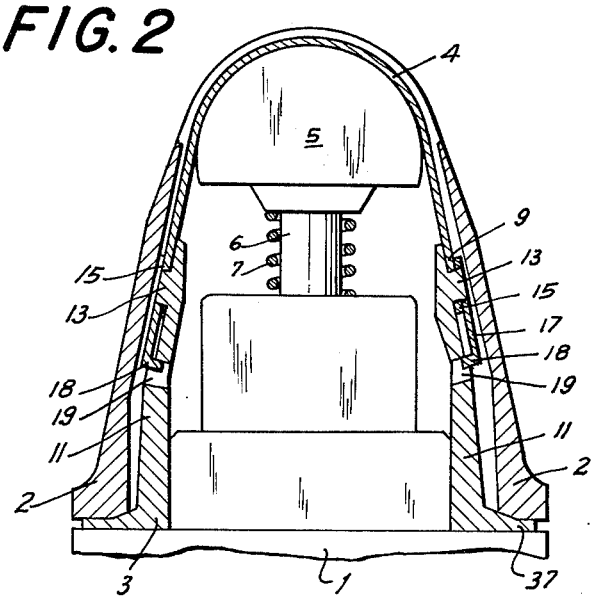
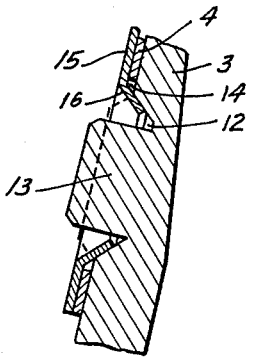
FIG. 4
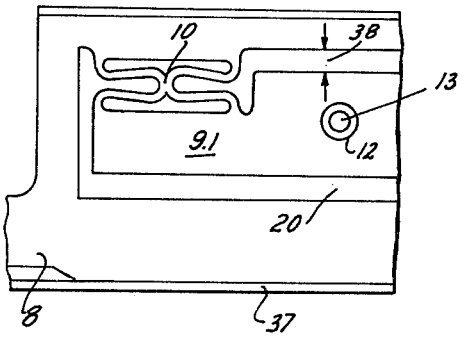
FIG. 5
FIG. 3
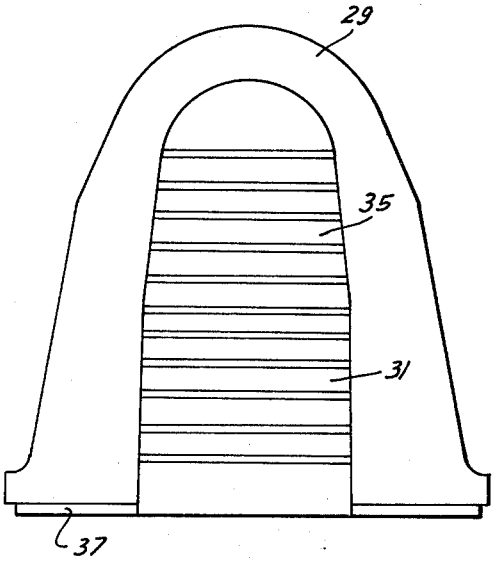

DRY SHAVING APPARATUS

BACKGROUND OF THE INVENTION

The present invention relates to a dry shaving apparatus. More particularly, it relates to a dry shaving apparatus having a shearing head frame and an auxiliary frame which is insertable into the shearing head frame.

Dry shaving apparatuses of the above-mentioned general type are known in the art, as disclosed for example, in the German Pat. No. 2,203,826. Such an apparatus has the disadvantage in that a shearing foil is rigidly supported and thereby it does not yield under the action of shaving pressure but buckling. As a result of this the contact face between both shearing parts decreases and the shaving foil can be damaged by buckles in extreme cases. Moreover, such damage can also take place when arresting of the auxiliary frame in the shearing head frame is performed at the same side of the auxiliary frame at which side the shearing foil is mounted, inasmuch as the shearing foil during each arresting of the auxiliary frame, for example for cleaning of the shearing head from hair dust, is subjected to bending.

The same disadvantage is characteristic for another known construction disclosed in the Japanese Utility Model application No. 45-67905 published under No. 49-2702. In the latter construction, arms are provided on the longitudinal sides of the auxiliary frame on which sides the shearing foil is mounted. The auxiliary frame is inserted by these arms into respective recesses of the shearing head frame. In this construction during each engagement and disengagement of the auxiliary frame, the shearing foil is subjected to mechanical loading and thereby can be damaged. The shearing foil, in view of the kind of arresting action, is not sufficiently fixed in the working direction of the blade block, so that the shearing foil is driven from the blade block and can be displaced by vibrations, whereby the shearing effect can be considerably affected.

SUMMARY OF THE INVENTION

Accordingly, it is an object of the present invention to provide a dry shaving apparatus which avoids the disadvantages of the prior art.

More particularly, it is an object of the present invention to provide a dry shaving apparatus in which a shearing foil has a support in a shearing head frame which is yieldable in positive direction of a blade block-pressure spring and is rigid in working direction of the blade block, and which allows easy removal of the shearing foil from the shearing head frame without additional mechanical loading of the shearing foil.

Keeping with these objects and with others which will become apparent hereinafter, one feature of the present invention resides, briefly stated, in a dry shaving apparatus in which an auxiliary frame mounting a shearing foil is fixed to the latter at at least one longitudinal side and is resiliently yieldable, and means is provided for aresting the auxiliary frame in a shearing head frame at the ends of the latter.

Novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 2 is a view along line II—II of FIG. 1 of the shearing head frame with the auxiliary frame mounted on a housing with a lower blade;

FIG. 3 is a view showing an end wall of the shearing head frame with the auxiliary frame of FIG. 1;

FIG. 4 is a view showing a fragment of the inventive apparatus; and

FIG. 5 is a view substantially corresponding to that shown in FIG. 1, but illustrating another embodiment of the invention.

DESCRIPTION OF THE PREFERRED EMBODIMENTS

Figure 1:
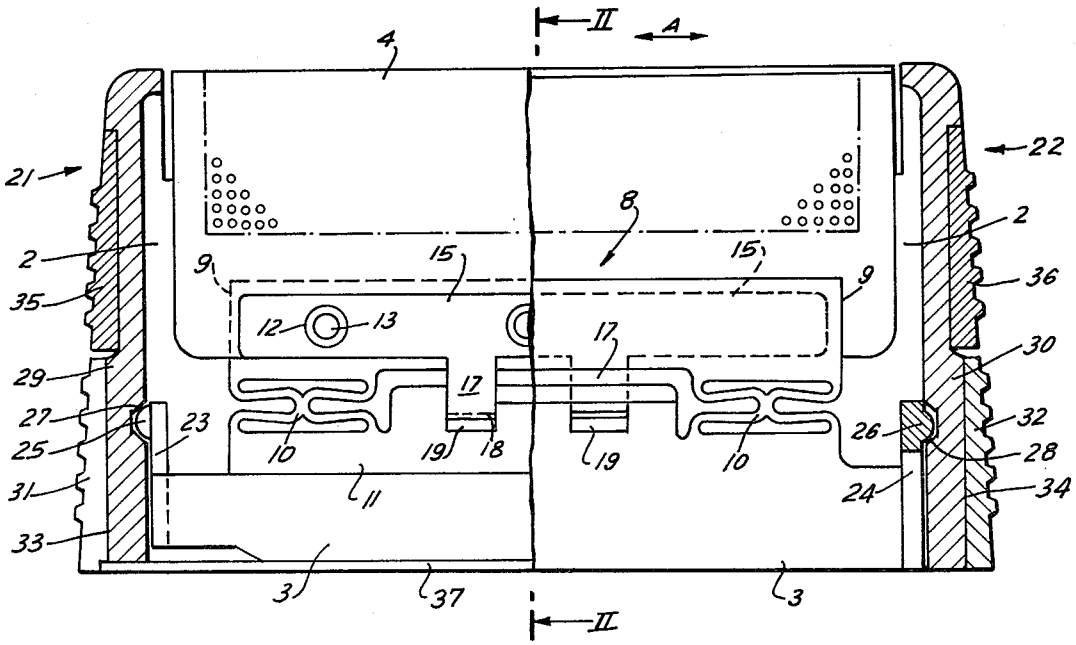
FIG. 1 is a view showing a longitudinal section of a shearing head frame of a dry shaving apparatus with an inserted auxiliary frame.

A dry shaving apparatus in according with the present invention has a housing 1 and a shearing head frame 2 removably mounted on the housing. An auxiliary frame 3 is inserted in the frame 2. A shearing foil 4 is mounted on the auxiliary frame 3 as will be explained hereinafter. The shearing foil 4 cooperates with a lower blade 5 driven in reciprocating motion by a not shown motor which is accommodated in the housing 1, through a rocking lever 6. A helical spring 7 presses the lower blade 5 in known manner against the shearing foil 4.

Projections 9 are provided at longitudinal sides 8 of the auxiliary frame 3. the projections 9 are connected with a base 11 of the auxiliary frame 3 by bending springs which are substantially X-shaped, that is provided with crossing arms. The projections 9, the bending springs 10, and the base 11 of the auxiliary frame are of one piece with each other and constituted of a synthetic plastic material. They are manufactured so that all three parts of the auxiliary frame 3 are located substantially in one plane.

The special design of the bending springs 10 allows springy displacement of the projections 9 with the shearing foil 4 mounted thereon, for example, against the base 11 of the auxiliary frame 3 in positive direction and in coordination with the pressure spring 7 of the lower blade 5; however, on the other hand, it prevents movement or vibration of the shearing foil in the direction of the working movement (arrow A) of the lower blade 5.

Mounting of the shearing foil 4 on the projections 9 of the auxiliary frame 3 is performed with the aid of funnel-shaped depressions 12 with pins 13 at the outer sides. The shearing foil is provided with mounting holes 14 at respective locations, whose diameter is at least equal to the diameter of the depressions 12. Finally, elongated sheets 15 are provided, which have cutouts corresponding to the mounting locations with offset flanges 16. The latter extend through the mounting holes 14 of the shearing foil 4 and engage in the depressions 12 of the auxiliary frame 3.

After mounting the shearing foil 4 and the sheets 15 on the projections 9, the pins 13 are converted by heating into rivet heads overlapping the flanges 16, as shown by dotted line in FIG. 4. In order to limit a spring stroke determined by the length of the arms of the X-shaped springs 10, strips 17 are formed on the sheets 15. The strips 17 engage by hooks 18 in cutouts 19 of the base 11 of the auxiliary frame 3. The height of the cutouts 19 thereby determines the spring stroke.

In accordance with another embodiment shown in FIG. 5, a cutout 20 is provided at each of the longitudinal sides 8 of the auxiliary frame 3. A projection 9.1 suspended on the X-shaped spring 10 is accommodated in the cutout 20. The dimension of the projection 9.1 in the direction of movement of the spring is smaller than the width of the cutout 20 in vertical direction by the permissible spring stroke 38. The inner edges of this cutout 20 thereby serve as limiting abutment for the projections 9.1.

In order to prevent mechanical loading of the shearing foil 4 during insertion of the auxiliary frame 3 into or withdrawal of the same out of the shearing head frame 2, arresting means is provided at end sides 21 and 22 of the auxiliary frame 3. This means is formed by two tongues 23 and 24 which are springy to a limited extent and engage with hemispheres 25 and 26 located in depressions 27 and 28 on an inner face of side walls 29 and 30 of the shearing head frame 2. Gripping plates 31 and 32 are provided on the end sides 21 and 22 and form abutment and means for easy handling of the auxiliary frame 3. The gripping plates 31 and 32 abut against outer faces 33 and 34 of the side walls 29 and 30 of the shearing head frame 2 when the auxiliary frame 12 is in mounted position.

Also for better mounting and dismounting of the shearing head frame, the side walls 29 and 30 of the shearing head frame 2 are provided with gripping faces 35 and 36, so that when the auxiliary frame 3 is in inserted position its gripping plates 31 and 32 are located below the gripping faces 35 and 36, as can be seen from FIG. 3.

Finally, the auxiliary frame 3 has a circular flange 37 on which the shearing head frame 2 is seated after fitting of both structural parts. The flange 37 may be utilized as a knocking edge for cleaning of the shearing head which excludes strong impacts especially in the case of the metallic shearing head frame.

For mounting or dismounting purposes, the shearing head frame 2 is grasped by a finger of one hand in the region of their gripping faces 35 and 36, whereas a finger of the other hand engages the gripping plates 31 and 32 of the auxiliary frame. The arresting of the auxiliary frame can thereby be performed with any frequency without reaction of this manipulation onto the shearing foil and also without influencing in any way the elasticity of spring-biasing of the shearing foil support.

It will be understood that each of the elements described above, or two or more together, may also find a useful application in other types of constructions differing from the types described above.

While the invention has been illustrated and described as embodied in a dry shaving apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A dry shaving apparatus, comprising a shearing foil; a blade member which is reciprocable and cooperates with said shearing foil; a pressure spring arranged to urge said blade member toward said shearing foil, said blade member and said pressure spring extending in a first direction; a shearing head frame; an elongated auxiliary frame insertable into said shearing head frame and having ends spaced from one another in a direction of elongation, said auxiliary frame mounting said shearing foil so that the latter is convex and having at least one longitudinal side at which it is fixed to said shearing foil, said auxiliary frame being resiliently yieldable in said first direction; and means for arresting said auxiliary frame in said shearing head frame at said ends of said auxiliary frame.

2. An apparatus as defined in claim 1, wherein said auxiliary frame has a base portion, two projections arranged to mount said shearing foil, and bending springs connecting said projections with said base portion.

3. An apparatus as defined in claim 2, wherein each of said bending springs has arms which cross each other.

4. An apparatus as defined in claim 3, wherein said arms of said bending springs are of one piece with said base portion and said projections.

5. An apparatus as defined in claim 2; and further comprising means for limiting the stroke of said bending springs and located between said projections and said base portion of said auxiliary frame.

6. An apparatus as defined in claim 5, wherein said auxiliary frame has two cutouts each accommodating a respective one of said projections, each of said cutouts having a dimension in said first direction exceeding a permissible stroke of said bending springs and being bounded by a wall portion forming said limiting means.

7. An apparatus as defined in claim 5, wherein said auxiliary frame has two recesses formed at locations determined by the stroke of said bending springs; and further comprising two strips located between said projections and said base portion and engageable into said recesses, so that said strips and said recesses form said limiting means.

8. An apparatus as defined in claim 7, wherein each of said strips has a hook portion engageable in a respective one of said recesses.

9. An apparatus as defined in claim 7; and further comprising two cover sheets resting on said shearing foil in the regions wherein the latter is mounted on said auxiliary frame, said strips being formed on said cover sheets.

10. An apparatus as defined in claim 1, wherein said shearing head frame has side walls having outer faces, said arresting means including resiliently yieldable tongues provided with hemispheres engaging said side walls of said shearing head frame, and gripping plates resting on said outer faces of said side walls in inserted position of said auxiliary frame.

11. An apparatus as defined in claim 10, wherein said side walls of said shearing head frame having gripping faces arranged so that in inserted position of said auxiliary frame said gripping plates are located below said gripping faces.

12. An apparatus as defined in claim 2, wherein each of said projections has an outer side, a depression at said outer side, and a pin located in said depression, said shearing foil having mounting openings by which it is fitted onto said pins and which have a diameter corresponding to that of said pins.

13. An apparatus as defined in claim 12; and further comprising sheet members each covering said shearing foil in the region of a respective one of said mounting openings and having a cutout with an offset flange which extends through a respective one of said mounting openings and engages in a respective one of said depressions.

14. An apparatus as defined in claim 1, wherein said auxiliary frame has a circular flange on which said shearing head frame is seated.

* * * * *